United States Patent [19]

Boyd

[11] Patent Number: 4,750,267

[45] Date of Patent: Jun. 14, 1988

[54] FOLDING BLADE KNIFE

[76] Inventor: Francis M. Boyd, 1015 Girard St., San Francisco, Calif. 94134

[21] Appl. No.: 921,481

[22] Filed: Oct. 22, 1986

[51] Int. Cl.[4] ..... B26B 1/04

[52] U.S. Cl. ..... 30/161

[58] Field of Search ..... 30/161, 160, 159; 7/118, 119, 120

[56] References Cited

U.S. PATENT DOCUMENTS

| | | | |
|---|---|---|---|
| 900,339 | 10/1908 | Woodruff | 7/119 X |
| 2,183,901 | 12/1939 | Weaver | 30/161 |
| 3,942,249 | 3/1976 | Poehlmann | 30/161 X |
| 4,170,061 | 10/1979 | Henry | 30/160 |
| 4,272,887 | 6/1981 | Poehlmann | 30/161 |
| 4,404,748 | 9/1983 | Wiethoff | 30/161 |
| 4,541,175 | 9/1985 | Boyd et al. | 30/161 |

*Primary Examiner*—Paul A. Bell
*Attorney, Agent, or Firm*—Anthony A. O'Brien

[57] ABSTRACT

A folding blade knife is disclosed in which the knife blade is releasably lockable in a plurality of angular positions relative to a knife handle. The folding knife blade has a polygonal aperture and the knife handle has a circular opening as well as an aligned polygonal recess. A one piece lock and release element operated by push button action includes a cylindrical part engaging in the circular opening of the handle and a polygonal part engageable totally in the polygonal aperture of the blade or partly in such aperture and partly in the polygonal recess of the handle. A spring biases the one piece lock and release element toward a locking position relative to the blade and handle.

10 Claims, 3 Drawing Sheets

FOLDING BLADE KNIFE

BACKGROUND OF THE INVENTION

1. Technical Field

The present invention relates to folding blade knives and more particularly relates to an improved multi-position positive acting folding blade lock mechanism.

2. The Prior Art

Prior U.S. Pat. No. 4,541,175 discloses a locking mechanism for a folding blade knife which enables the folding blade to be positively locked in any one of three positions and released or unlocked by a push button locking mechanism. One embodiment of the patented invention includes separately formed dead and actuating buttons with the actuating button being spring-biased to a locking position relative to the folding blade. A second embodiment of the patented invention discloses a unified spring-biased push button arrangement for locking and releasing the folding knife blade at any one of three positions spaced 90° apart.

Both embodiments of the patented invention involve screw-threaded connections in the locking mechanisms and both involve relatively difficult machining operations including the formation of a square recess in one of the blade handle members.

It is the object of the present invention to improve on the patented knife in several respects including the complete elimination of all screw-threads and simplifying and rendering less costly the machining operations involved in manufacturing the knife.

Another object of the invention is to provide a folding blade knife having a three position positive lock for the knife blade operated by a push button action which is applicable to either single or dual blade knives. The locking mechanism is such that the knife will operate only in a completely legal manner requiring the use of two hands to open the folding blade at the time of releasing the lock. The blade will not open by gravity action.

Still another object of the invention is to provide a multi-position locking mechanism for folding blade knives which is more simplified than the known prior art.

Other objects and advantages of the invention will become apparent to those skilled in the art during the course of the following description.

SUMMARY OF THE INVENTION

The invention is best summarized as a push button multi-position positive lock for a folding blade knife having either a single blade or two blades. The blade or blades are lockable in three positions spaced apart 90°, namely, with the folding blade safely enclosed between two handle members, fully extended longitudinally beyond one end of the handle, and extending perpendicular to the handle in an intermediate position of use. The locking mechanism for the blade or blades consists of a single or dual push button arrangement characterized by the complete absence of screw-threads and including a single biasing spring acting on one or both push buttons. The push button or buttons include a square locking portion adapted to enter a square locking aperture in the folding knife blade to positively lock the blade in any of three positions. Depressing of the push button or buttons and compression of the biasing spring will release the folding blade for movement to another position responsive to movement of the blade by a hand of the user of the knife.

DETAILED DESCRIPTION

Figure 1:
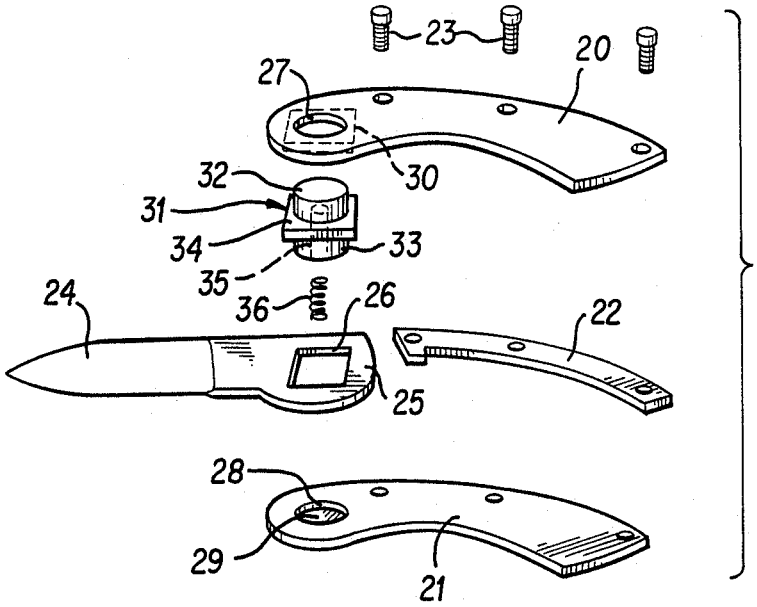
FIG. 1 is an exploded perspective view of a folding blade knife and blade locking mechanism according to one preferred embodiment of the invention.
Figure 2:
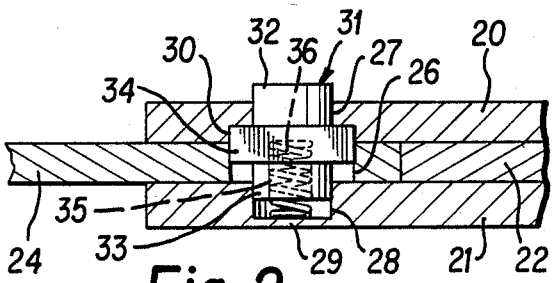
FIG. 2 is a vertical section through the knife and locking mechanism with the mechanism in a blade locking position.

Referring to the drawings in detail wherein like numerals designate like parts, FIGS. 1 and 2 of the drawings show a single blade folding blade knife having a single push button lock. The knife comprises opposite side handle plates 20 and 21 intervened by a spacer bar 22. Screws 23 are employed to connect the elements 20, 21 and 22 in assembled relationship with a folding knife blade 24 disposed between the plates 20 and 21 forwardly of the spacer bar 22.

In its rear end portion 25, the knife blade has a preferably square aperture 26 formed therethrough in registration with a circular opening 27 in the forward end portion of plate 20 and a circular recess 28 having a bottom wall 29 in the opposing plate 21. The recess 28 opens through the interior face of the plate 21. The interior face of the plate 20 has a square recess 30 formed therein having the same dimensions as the square aperture 26 of the knife blade.

A push button blade locking and release unit 31 includes a cylindrical push button extension 32 forming a first trunnion and an opposite end cylindrical extension 33 of the same diameter as the extension 32 forming a second trunnion. The elements 32 and 33 engage movably within the opening 27 and recess 28, respectively, for rotation or longitudinal movement therein.

Near its longitudinal center, the unit 31 is provided with a square plate portion 34 having substantially the same dimensions as the square aperture 26 and square recess 30 and being engageable shiftably therein. Preferably, the plate portion 34 has substantially the same thickness as the knife blade end portion 25.

The unit 31 has a center longitudinal cylindrical recess 35 formed therein of lesser diameter than the trunnions 32 and 33 and opening through the end face of trunnion 33 and terminating within the unit 31 near its longitudinal center. A compression spring 36 is contained within the recess 35 and has one end bearing on one end wall of this recess and its other end bearing on the wall 29. The spring 36 is thus captively held within the blade lock and release structure in a concealed manner.

The spring 36 biases the unit 31 to the position shown in FIG. 2 where the folding blade 24 is positively locked in one of three possible positions 90° apart, as disclosed in U.S. Pat. No. 4,541,175. The square plate portion 34 is engaged partly in the square blade aperture 26 and partly in the square recess 30. Therefore, the blade 24 cannot rotate nor can the unit 31 rotate.

Figure 3:
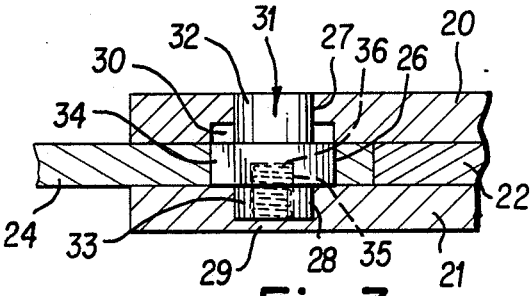
FIG. 3 is a similar view showing the locking mechanism in an unlocked or blade releasing position.

To unlock the blade 24 for movement to a second position, the push button extension 32 forming the first trunnion is depressed axially, FIG. 3, compressing the spring 36 and shifting the square plate portion 34 fully into the square aperture 26 and entirely out of the square recess 30. While the unit 31 is thus positioned, the blade 24 can be moved to another of its three positions spaced 90° from the position in FIG. 3. When the new position is reached, the square plate portion 34 will snap into the square recess 30 under influence of the spring 36, and the blade 24 is again securely locked. The unit 31 is now returned to its position in FIG. 2. During rotation of the blade 24 between its three positions, the unit 31 turns with the blade relative to the handle plates 20 and 21 and the elements 32 and 33 function as trunnions.

The described structure includes no screw-threaded parts and the push button locking and unlocking element 31 is formed in one piece with minimal low cost machining. The structural and operational advantages of the invention over the prior art should now be apparent to those skilled in the art, as well as its greater simplicity.

Figure 4:
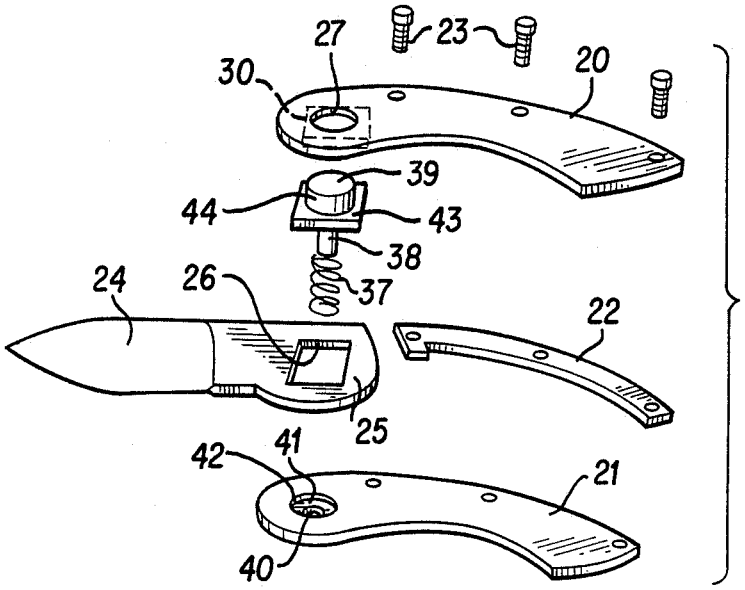
FIG. 4 is an exploded perspective view showing a modification of the invention.
Figure 5:
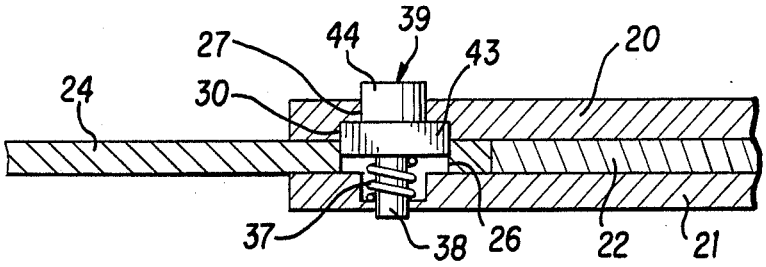
FIG. 5 is a vertical section, similar to FIG. 2, showing the knife blade locked in the modification of FIG. 4.
Figure 6:
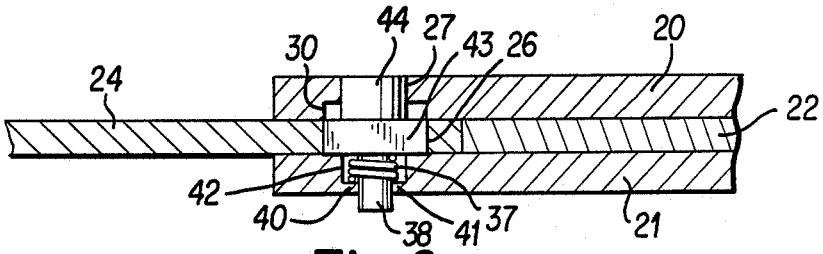
FIG. 6 is a vertical section, similar to FIG. 3, showing the blade in FIG. 4 unlocked.

FIGS. 4 to 6 of the drawings show a modification of the device in FIGS. 1 to 3 in which a compression spring 37 is mounted externally on a center cylindrical stem 38 or pin extension of a knife blade lock and release unit 39, which is otherwise very similar to the unit 31. The reduced diameter stem 38 is received slidably and rotatably through a circular aperture 40 formed in the bottom wall 41 of a cylindrical recess 42 similar to the recess 28. The unit 39 includes an intermediate square plate portion 43 and cylindrical push button extension 44 which are substantially identical in construction and operation to the corresponding elements 34 and 32 of the prior embodiment, FIGS. 1 to 3.

The identical knife blade 24 with square opening 26 is employed along with the identical handle plates 20 and 21, spacer bar 22, and screws 23.

The mode of operation of the blade lock and release means in FIGS. 4 to 6 is basically identical to that described for the prior embodiment and need not be repeated. The stem 38, in addition to positioning the spring 37, forms one of the rotation trunnions of the one piece push button blade lock and release unit 39, the push button extension 44 forming the other trunnion.

Figure 7:
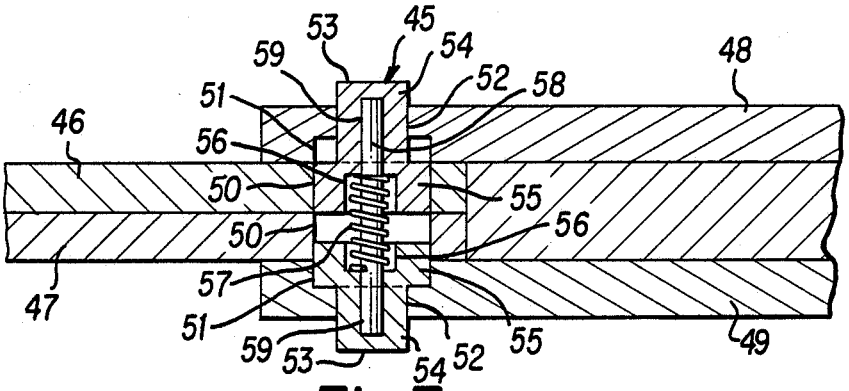
FIG. 7 is a vertical section through a dual folding blade knife and dual push button locking mechanism therefor according to another embodiment of the invention.
Figure 8:
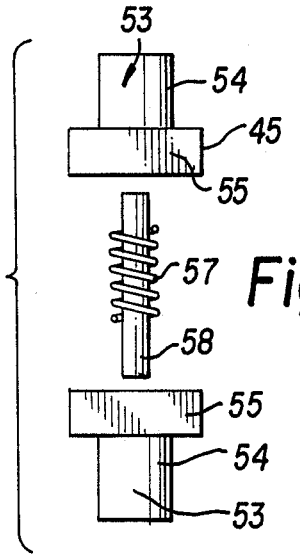
FIG. 8 is an exploded elevational view of the dual push button locking mechanism.
Figure 9:
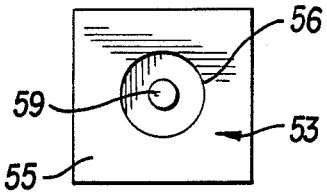
FIG. 9 is an end elevation of one locking push button in the structure shown in FIG. 7.

FIGS. 7 to 9 show another embodiment of the invention including simplified lock and release means 45 for a knife having two folding blades 46 and 47 connected with a knife handle having two side plates 48 and 49 and an intervening spacer.

Each blade 46 and 47 has a square aperture 50 of equal size and each handle plate 48 and 49 has an interior side square recess 51 adapted to register with one of the blade apertures 50 whenever one of the blades 46 or 47 is positioned at one of its three lockable positions. Each plate 48 and 49 has a cylindrical opening 52 formed therethrough and these openings are of the same diameter and coaxially aligned and also centered with respect to the square recesses 51.

Two axially opposed independently operable blade lock and release push buttons 53 of identical construction are provided. Each includes a cylindrical extension 54 serving as a push button and trunnion and each further includes a square plate or head 55 engageable shiftably in the square blade apertures 50 and square recesses 51. Each element 55 has an end face center cylindrical recess 56 which receives and seats one end portion of an expansion coil spring 57 which surrounds a center axial distance rod 58. The cylindrical rod 58 has its opposite end portions received in cylindrical center bores 59 of the two elements 53 whereby inward linear travel of the elements 53 is positively limited by the rod. Outward displacement of the elements 53 under influence of the expansion spring 57 is limited by contact of the square heads 55 with the end walls of square recesses 51.

FIG. 7 shows the folding blade 46 unlocked and the blade 47 locked. The push button 54 has been depressed out of the recess 51 and fully into the recess 50 of the blade 46 so that the latter is free to turn relative to the knife handle to the next 90° lockable position at which the head 55 will snap back into the recess 51 of handle plate 48 to re-lock the blade 46.

The blade 47 is locked and released independently and in the identical manner. It is shown locked in FIG. 7, and to release it the associated push button 54 is depressed out of the recess 51 and fully into the recess 50 of the blade 47, as described above for the blade 46.

Figure 10:
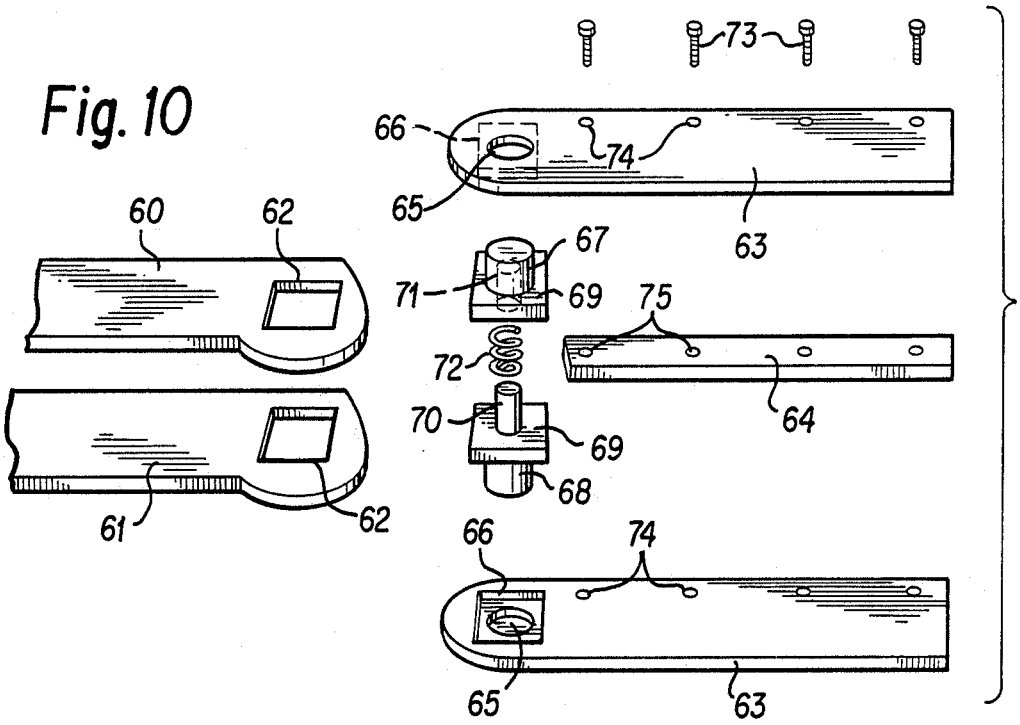
FIG. 10 is an exploded perspective view of a dual folding blade knife and push button locking mechanism in accordance with a further embodiment of the invention.
Figure 11:
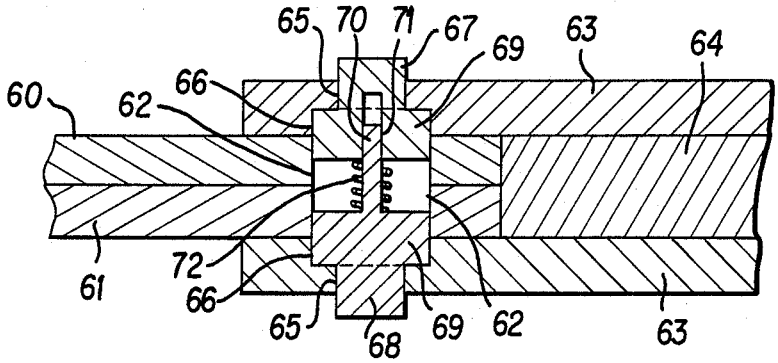
FIG. 11 is a cross sectional view through the assembled knife and locking mechanism in FIG. 10 with both knife blades locked.
Figure 12:
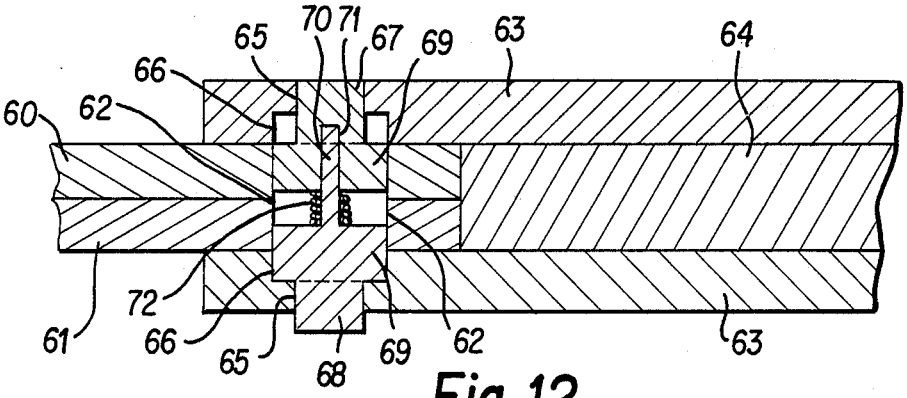
FIG. 12 is a similar view showing one knife blade unlocked.

FIGS. 10, 11 and 12 show a further embodiment of the invention for a dual folding blade knife. Separate folding blades 60 and 61 have square apertures 62 formed therethrough. Handle plates 63 intervened by a spacer bar 64 have cylindrical openings 65 in their corresponding forward ends and also have square recesses 66 on their opposing interior faces.

Cylindrical push buttons 67 and 68 forming first and second trunnions include integral square plates or heads 69 adapted to enter the square apertures 62 and square recesses 66 at proper times.

The square plate 69 on its interior side carries an integral guide and locator cylindrical pin 70 which is received in a central blind bore 71 of the push button-plate unit 67–69. An expansion spring 72 surrounds the pin 70 and has its opposite ends bearing on the opposed end faces of the square plates 69 tending to urge them apart axially.

Each blade 60 and 61 is independently unlocked for movement to any one of its three positions merely by depressing the associated push button 67 or 68, whereby the spring 72 which serves both blade locks is compressed, FIG. 12, while the associated square plate 69 moves out of the square recess 66 and moves fully into the square aperture 62 of the associated folding blade 60 or 61. FIG. 12 shows the blade 60 in the unlocked mode. The identical procedure takes place for unlocking the blade 61, namely, the depression of the push button 68. When the desired adjustment of the knife blade through 90° is made in this manner, the square plate 69 under influence of the spring 62 will snap back into the locking recess 66 automatically when the new blade position is reached. Both blades can be adjusted simultaneously by depressing both push buttons 67 and 68 and the same is true for the structure depicted in FIG. 7.

As in the prior embodiments, the parts are held in assembled relationship by screws 73 engaging through apertures 74 and 75 of the elements 63 and 64.

In each embodiment of the invention, a one piece lock, push button actuator is utilized for each blade in association with a single return spring. No screw-threaded components are employed except for the screws which secure the handle plates assembled with the other elements of the knife.

Inasmuch as the present invention is subject to many variations, modifications and changes in detail, it is intended that all matter contained in the foregoing description or in the accompanying drawings shall be interpreted as illustrative and not in a limiting sense.

I claim:

1. A folding blade knife comprising a blade having a polygonal aperture, a handle having a circular opening means and a polygonal recess means in coaxial alignment, a threadless one piece lock and release element for said blade including a push button and having an integral trunnion part engageable within said circular opening means of said handle and having an integral polygonal part engageable within the polygonal aperture of said blade and within said polygonal recess means of the handle selectively whereby the blade can be locked to the handle in plural angularly adjusted positions or released for angular movement relative to the handle, and a single expansible coil spring connected with said one piece lock and release element and urging the latter in a direction causing said polygonal part to enter said polygonal recess means while being partially engaged within said polygonal aperture.

2. A folding blade knife as defined in claim 1, and said polygonal aperture, polygonal recess means and polygonal part all being substantially square.

3. A folding blade knife comprising a blade having a polygonal aperture, a handle having a circular opening means and a polygonal recess means in coaxial alignment, a threadless one piece lock and release element for said blade including a push button and trunnion part engageable within said circular opening means of said handle and a polygonal part engageable within the polygonal aperture of said blade and within said polygonal recess means of the handle selectively whereby the blade can be locked to the handle in plural angularly adjusted positions or released for angular movement relative to the handle, a single expansible coil spring connected with said one piece lock and release element and urging the latter in a direction causing said polygonal part to enter said polygonal recess means while being partially engaged within said polygonal aperture, and a cylindrical extension on said polygonal part away from said push button and trunnion part and being coaxially therewith, and said coil spring being engaged with said cylindrical extension and being located thereby relative to said one piece lock and release element.

4. A folding blade knife as defined in claim 3, and said coil spring surrounding said cylindrical extension and being seated in a cylindrical recess of said handle.

5. A folding blade knife as defined in claim 3, and said cylindrical extension having a blind bore receiving said coil spring and said handle having a blind bore receiving said cylindrical extension and serving as a seat for one end of said coil spring.

6. A folding blade knife comprising a blade having a polygonal aperture, a handle having a circular opening means and a polygonal recess means in coaxial alignment, a threadless one piece lock and release element for said blade including a push button and trunnion part engageable within said circular opening means of said handle and a polygonal part engageable within the polygonal aperture of said blade and within said polygonal recess means of the handle selectively whereby the blade can be locked to the handle in plural angularly adjusted positions or released for angular movement relative to the handle, a single expansible coil spring connected with said one piece lock and release element and urging the latter in direction causing said polygonal part to enter said polygonal recess means while being partially engaged within said polygonal aperture, and a second blade in side-by-side relationship to the first-named blade and having a polygonal aperture adapted to register with the polygonal aperture of the first-named blade, the polygonal recess means of the handle including a pair of opposing polygonal recesses in the handle aligned with said circular opening means, and a threadless second one piece lock and release element for said second blade.

7. A folding blade knife as defined in claim 6, and said single expansible coil spring being captively held between said one piece lock and release elements for the first and second blades.

8. A folding blade knife as defined in claim 7, and a rod extending between said one piece lock and release elements and being held within a pair of coaxial blind bores thereof, and said spring surrounding said rod and having ends seated within axially aligned recesses of the lock and release elements adjacent to said bores.

9. A folding blade knife as defined in claim 7, and an axial pin on one lock and release element, the second lock and release element having a blind bore receiving said pin, and said expansible spring surrounding said pin between said lock and release elements and having opposite ends bearing against opposing end faces of said elements.

10. A folding blade knife comprising a blade having a polygonal aperture formed therethrough near one end thereof, a handle including two parallel handle plates straddling said blade each having a circular opening in coaxial alignment with the polygonal aperture of said blade and one having an interior side polygonal recess of the same size and shape as said polygonal aperture and adapted to be aligned therewith, a threadless one piece lock and release element having a cylindrical push button part engageable within the circular opening of one handle plate and a polygonal intermediate part engageable bodily within the polygonal aperture of said blade and engageable partly within said aperture and partly within said polygonal recess means, an extension on said one piece lock and release element at its end away from said push button part and being rotatably engaged with said handle, and an expansible spring engaged with said extension and having one end bearing on said handle and another end bearing on said one piece lock and release element and biasing the latter toward a blade locking position of said lock and release element.

* * * * *